US005800235A

United States Patent [19]

Ragsdale

[11] Patent Number: 5,800,235

[45] Date of Patent: Sep. 1, 1998

[54] PROCESS FOR MANUFACTURING INCANDESCENT LAMPS HAVING GETTERING AGENTS

[75] Inventor: Charles R. Ragsdale, Newport Beach, Calif.

[73] Assignee: Illumination Technology, Inc., Cypress, Calif.

[21] Appl. No.: 607,723

[22] Filed: Feb. 27, 1996

[51] Int. Cl.[6] ..... H01K 1/10; H01K 1/56; H01K 3/02

[52] U.S. Cl. ..... 445/48; 445/41; 427/111

[58] Field of Search ..... 445/41, 48, 55, 445/9; 427/111

[56] References Cited

U.S. PATENT DOCUMENTS

| | | | |
|---|---|---|---|
| 3,351,407 | 11/1967 | Zarins | 445/55 |
| 3,475,072 | 10/1969 | Graves | 445/55 |
| 3,785,019 | 1/1974 | Chiola et al. | 445/32 |
| 3,989,549 | 11/1976 | Cangiano et al. | 140/71.5 |
| 4,927,398 | 5/1990 | Shaffer | 445/55 |

*Primary Examiner*—Kenneth J. Ramsey
*Attorney, Agent, or Firm*—Klein & Szekeres, LLP

[57] ABSTRACT

Filaments having a thin exterior tungsten phosphide layer for use in incandescent lamps are made by exposing tungsten filaments to vapors of elemental phosphorous at approximately 675° to 725° C. in an evacuated vacuum furnace. The tungsten phosphide layer protects the filaments from oxidation while the lamps are manufactured, and decomposes to tungsten and phosphorous when the lamp is first energized by current. The resulting elemental phosphorous acts as a gettering agent.

16 Claims, 3 Drawing Sheets

FIG. 1
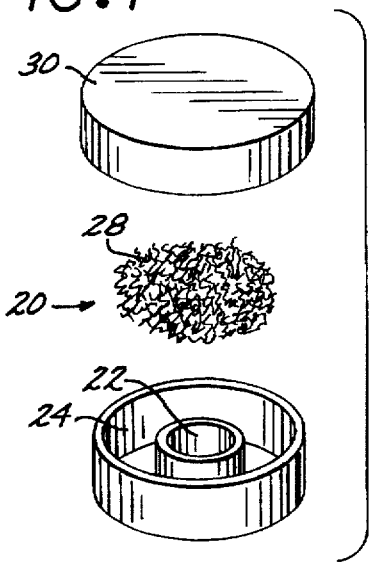
FIG. 3
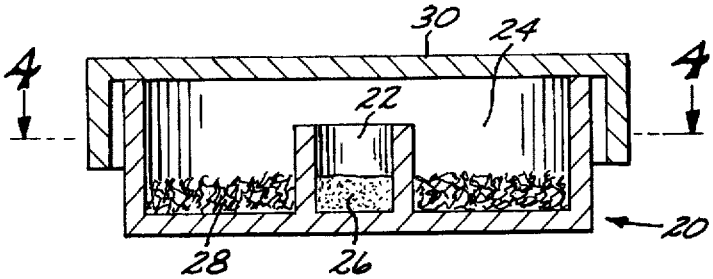
FIG. 4
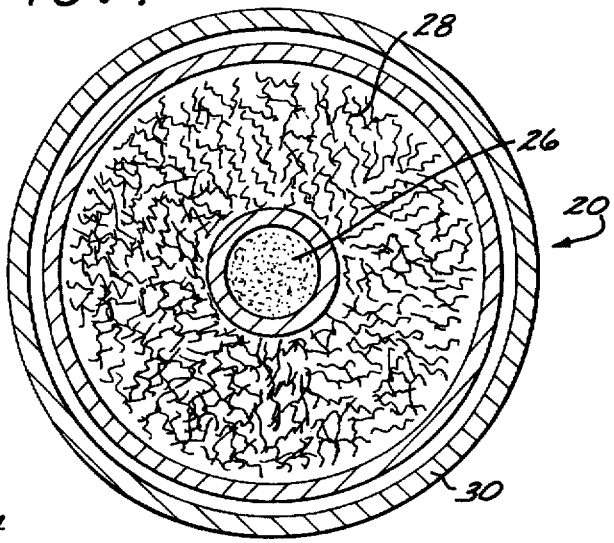
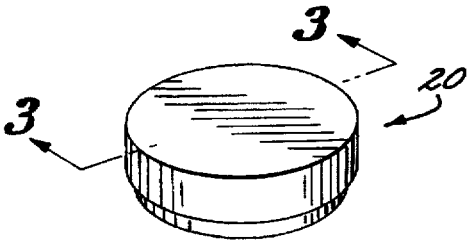
FIG. 2
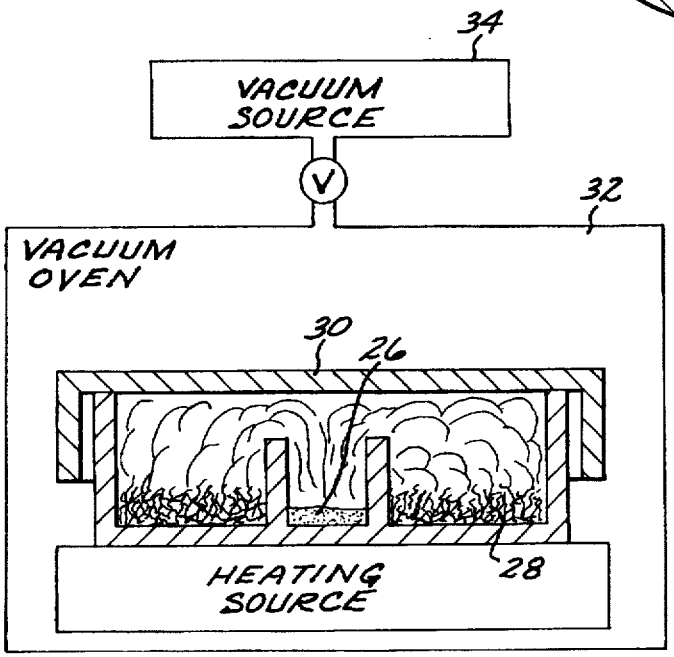
FIG. 5

PROCESS FOR MANUFACTURING INCANDESCENT LAMPS HAVING GETTERING AGENTS

BACKGROUND OF THE INVENTION

1. Field of the Invention

The present invention is directed to an improvement in the process of manufacturing incandescent lamps. More particularly, the present invention is directed to an improvement in the process utilized in the manufacture of incandescent lamps which include gettering agents.

2. Brief Description of the Prior Art

Miniature and subminiature incandescent lamps are usually made in a manufacturing process that involves a step of vacuum sealing. For a long time the industry has recognized the goal of having as perfect vacuum as possible within the interior of such lamps. Perfect or near perfect vacuum is considered necessary in order to avoid conduction of heat and deterioration of the incandescent tungsten filament by reaction with traces of gases (such as oxygen) and other impurities which may remain in the interior of the lamp after the vacuum sealing process is completed. In order to perfect the vacuum and remove the trace impurities from the interior of the lamp before the impurities react with the incandescent filament so-called "gettering" processes have been developed in the prior art. In a gettering process a small amount of a gettering substance or agent, such as phosphorous (P), is included in the interior of the vacuum sealed lamp. When the lamp is energized for the first time the gettering substance reacts with the trace gases and other impurities and forms vapors which condense as substantially invisible solid material on the relatively cool interior surface of the glass envelope of the lamp. In this manner and as a result of removal of trace impurities the vacuum present in the lamp is improved and reaction of the tungsten filament with the trace impurities is substantially prevented. Gettering agents can also be used in incandescent lamps which, instead of having vacuum inside, have an atmosphere of inert gas, such as xenon, krypton or argon. In these lamps also, the gettering agent reacts with traces of impurities (substances other than the inert gases) and thereby increases the purity of the inert gas atmosphere inside the lamp thereby prolonging the life of the lamp.

An established process in the art for manufacturing incandescent lamps is to dip the tungsten filaments, before their incorporation into the lamp, into a suspension of red phosphorous in a volatile solvent, such as amyl acetate. After dipping, the filaments are dried and incorporated into the lamps. The phosphorous that resides on the surface of the filament reacts with the trace impurities when power is supplied to the lamp and captures the impurities in the form of phosphides which deposit as solids within the interior of the glass envelope. Disadvantages of this process lie in the need for performing the steps of dipping and drying, and in that the tungsten filaments are exposed to the atmosphere during the manufacturing process thereby permitting some oxidation of the surface of the filament.

In another prior art variation of the manufacturing process, red phosphorous and tungsten filaments are sealed in an evacuated glass vessel. The vessel and its contents are heated to approximately 700° to 750° C. The heat causes tungsten phosphide ($WP_x$, where x is an integer) to form on the surface of the filaments. The vessel is cooled and thereafter broken open under water. Opening under water is necessary because some white phosphorous is formed during heating, and a fire or explosion may occur when the white phosphorous is exposed to oxygen. The filaments are washed with a solvent such as alcohol, and dried before being incorporated into lamps. When the lamp is energized the temperature of the filament rises substantially above the decomposition temperature of tungsten phosphide (approximately 1400° C.) and therefore elemental phosphorous vapors are formed by decomposition of the tungsten phosphide layer. The vapors act as a gettering agent and capture gaseous and other impurities in the lamp. However, the just described prior art process suffers from the serious disadvantages that the sealed glass vessel must be opened under water. Moreover, extra manufacturing steps are involved because of the need for washing with solvent and subsequently drying the filaments. In light of the foregoing, there is a need in the prior art for improvements in the process of manufacturing incandescent light bulbs which include gettering agents or components.

SUMMARY OF THE INVENTION

It is an object of the present invention to provide an improvement in the process of manufacturing incandescent lamps which include a gettering component or agent.

The foregoing and other objects and advantages are attained by a manufacturing process wherein tungsten lamp filaments and red phosphorous are evacuated and heated above approximately 675° C. in a vacuum furnace, exposing the filaments to the vapors of phosphorous, whereby tungsten phosphide ($WP_x$, where x is an integer) is formed on the surface of the filaments. The tungsten phosphide protects the filaments from oxidation during the rest of the manufacturing operation. After cooling, the filaments are incorporated into lamps. When the filament is first energized with the appropriate power source its temperature rises above the decomposition temperature of tungsten phosphide and yields vapors of elemental phosphorous. The phosphorous vapors then act as a gettering agent within the interior of the lamp.

The features of the present invention can be best understood together with further objects and advantages by reference to the following description, taken in connection with the accompanying drawings, wherein like numerals indicate like parts.

BRIEF DESCRIPTION OF THE DRAWINGS

FIG. 1 is an exploded perspective view of a first preferred embodiment of a vessel in which the process of the present is performed;

FIG. 2 is perspective view of the vessel shown in FIG. 1;

FIG. 3 is a cross-sectional view taken on lines 3,3 of FIG. 2;

FIG. 4 is another cross-sectional view taken on lines 4,4 of FIG. 3;

FIG. 5 is a schematic view, partly in cross section, of the apparatus wherein the process of the present invention is performed;

DESCRIPTION OF THE PREFERRED EMBODIMENTS

Figure 6:
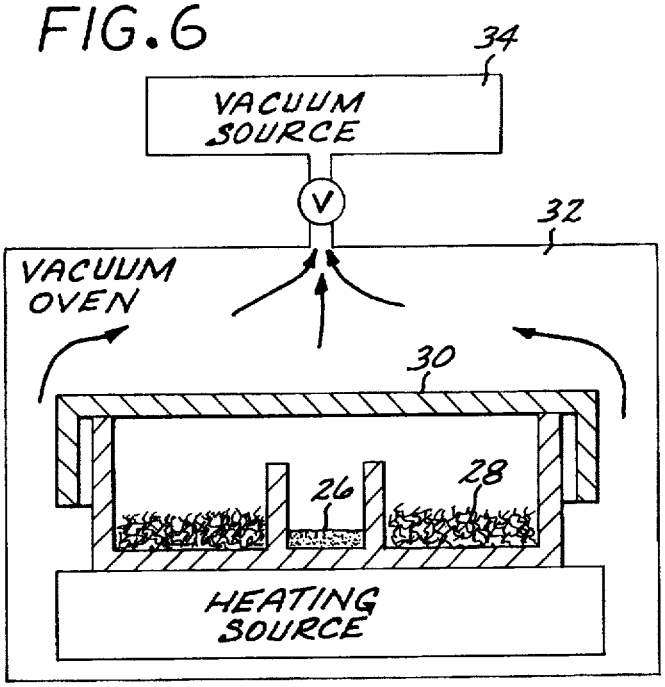
FIG. 6 is a schematic view, partly in cross section, of the apparatus wherein the process of the present invention is performed, the view showing the process in progress.
Figure 7:
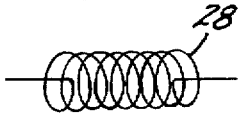
FIG. 7 is schematic top view of a filament made in accordance with the process of the present invention.

The following specification taken in conjunction with the drawings sets forth the preferred embodiments of the present invention. The embodiments of the invention disclosed herein are the best modes contemplated by the inventor for carrying out his invention in a commercial environment, although it should be understood that various modifications can be accomplished within the parameters of the present invention.

The process of the present invention is applicable to the manufacture of all incandescent lamps which benefit from the inclusion of gettering agents within the lamp. However, primary application of the present invention is in the manufacture of vacuum-sealed miniature and subminiature lamps. Miniature lamps are used in many applications such as in electronic and like appliances and equipment, with digital watches serving as prime examples. U.S. Pat. Nos. 5,138,226 and 5,382,874 the specifications of which are expressly incorporated herein by reference, describe miniature incandescent lamps in the manufacture of which the process of the present invention may be advantageously employed. Subminiature lamps, on the other hand, are frequently used in instrument panels, automotive dash boards and the like, and are typically designed to work with a power source between approximately 3 to 18 Volts. The present specification describes the process of the present invention primarily as it is used in connection with the manufacture of subminiature and miniature lamps, such as the lamps disclosed in the above-cited U.S. Pat. Nos. 5,138,226 and 5,382,874. Nevertheless, it should be understood that the present invention is not limited by the size of the incandescent lamp in which the process is applied. Nor is the inventive process limited for the manufacture of incandescent lamps that are evacuated and have vacuum rather than an inert gas atmosphere inside.

In accordance with the present invention incandescent filaments are exposed to the vapors of red phosphorous at an elevated temperature and in a reduced pressure atmosphere. FIGS. 1–6 of the appended drawings disclose a first preferred embodiment of an apparatus in which the process of the present invention is performed. Referring now to these drawing figures, a glass vessel 20, substantially in the shape of a modified Petri-dish, has a first compartment 22 which is surrounded by an annular space that forms a second compartment 24 of the vessel 20. Powdered reagent grade red phosphorous is placed in the first compartment 22, and a plurality of filaments are placed into the second compartment 24. The mass of phosphorous powder in the first compartment 22 is schematically shown in drawing FIGS. 3–6 and bears the reference numeral 26. The plurality or mass of filaments is schematically shown in FIGS. 1 and 3–6 and bears the reference numeral 28. The vessel 20 is covered by a loose fitting cover 30. It is to be understood however that the cover 30 does not provide a gas-tight or vacuum-tight closure for the vessel 20.

Dimensions of the filament, like the dimensions of the incandescent lamp itself, are not crucial from the standpoint of the present invention. Exemplary characteristics of filaments used in the process of the present invention and which are incorporated in the type of miniature lamps disclosed in U.S. Pat. Nos. 5,138,226 and 5,382,874 are as follows: the filament is made of tungsten-rhenium wire of 11μ (micron) diameter, the diameter of the coil is 0.004" (inch), length of the coil is 0.035", and there are approximately 11 turns in the coil. Another example of filaments used in the present invention and which are incorporated in subminiature lamps for use in instruments, automotive dash boards and like applications, have dimensions as follows: diameter of wire 20μ (micron), diameter of coil 0.0085", length of coil 0.22", and the coil contains approximately 70 turns.

Dimensions of the vessel 20 in which the red phosphorous powder and the filaments are placed are also not critical, and may be adapted to the volume of filaments which are to be processed in accordance with the invention. The herein described preferred embodiment of the vessel 20 has a diameter of approximately 1.5", with the first compartment 22 having a diameter of approximately 0.3125". In this example approximately 70 mg of reagent grade phosphorous is placed in the first compartment 22, and several thousand filaments of "miniature lamp dimensions" are placed into the annular space that comprises the second compartment 24.

Figure 9:
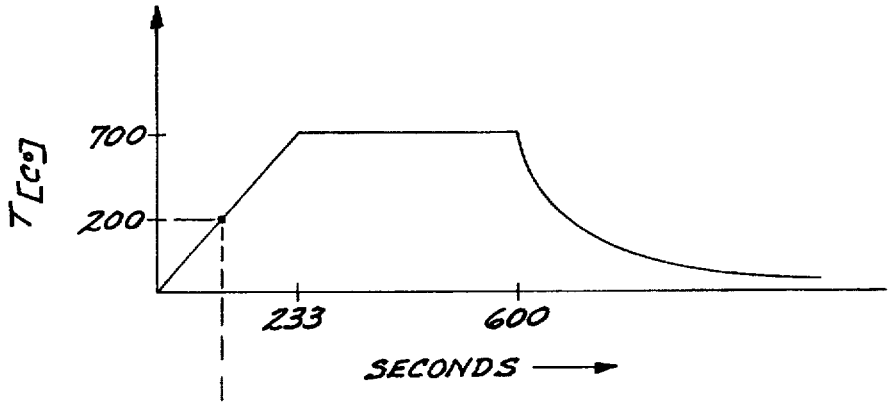
FIG. 9 is a graph showing the temperature in the vacuum furnace while the first preferred embodiment of the process of the invention is performed.
Figure 10:
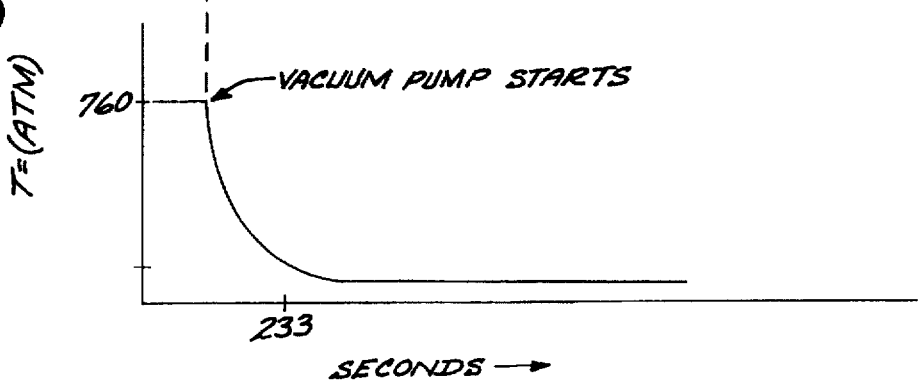
FIG. 10 is a graph showing the pressure in the vacuum furnace while the first preferred embodiment of the process of the invention is performed.

The vessel 20 containing the red phosphorous 26 and the filaments 28 is then covered, as shown in FIGS. 3 and 4 and placed in a vacuum furnace or oven 32. A state-of-the-art vacuum furnace or oven 32 is used in the process, and for that reason it is shown only schematically in FIGS. 5 and 6. The vacuum furnace 32 is first flushed with $N_2$ or other inert gas and then heated. After a temperature of approximately 200 °C. is attained inside the furnace 32, vacuum is applied while heating is continued, to raise the temperature to a plateau in the range of approximately 675° to 725° C. FIG. 5 schematically illustrates the phase in this heating process before vacuum is applied to the furnace 32, and FIG. 6 illustrates the process after vacuum is applied. It will be readily understood by those skilled in the art that a state-of-the-art vacuum furnace, such as the one utilized in connection with the present invention, is controlled by a computer (not shown) and the temperature and pressure profile can be determined by a program selected by an operator or technician (not shown). FIGS. 9 and 10 disclose the computer controlled temperature and pressure profile within the vacuum furnace 32 in the herein described preferred process of the invention. Thus, the graph of FIG. 9 shows that in the preferred process the temperature is "ramped" (raised in a linear fashion) to about 200° C. in approximately 2 minutes (120 seconds) at which time a valve opens to operatively connect a vacuum source 34 (vacuum pump) to the furnace 32. Heating is continued to linearly raise the temperature to approximately 725° C. while the pressure in the furnace 32 decreases rapidly. In approximately 233 seconds from the start of the heating process a temperature plateau of approximately 725° C. and a pressure minimum of approximately 100 millitorr is reached and these are maintained until approximately 600 seconds (ten minutes) have elapsed from the beginning of the heating process. Then heating is discontinued and vacuum is maintained while the interior of the furnace 32 is allowed to cool. Finally, the furnace 32 is flushed with inert gas, and the filaments 28 are removed.

Those skilled in the art will readily understand that the above-described temperature, time and pressure parameters are exemplary rather than limiting in nature, and that each of these parameters influence the proper selection for the remaining parameters. Generally speaking, however, the temperature in the furnace 32 should be above approximately 675° C. because that is where formation of tungsten phosphide begins to occur practically. The temperature should not exceed approximately 1400° C., because above that temperature the tungsten phosphide ($WP_x$) which is formed on the surface of the filaments, begins to decompose. The temperature in the furnace 32, however, must be high enough to cause reaction between the phosphorous vapors and the tungsten to form tungsten phosphide. Thus, a peak operating temperature in the furnace 32 of approximately 725° C. was found to be optimal, with a range of approximately 675° to 725° C. being practical in the apparatus used. For filaments to be used in subminiature lamps, (as compared to miniature lamps) and even larger lamps, the time of exposure to the phosphorous vapors may be extended up to approximately 20 minutes. Under these conditions also the optimal time period depends on the temperature and degree of vacuum attained in the furnace 32.

Figure 8:
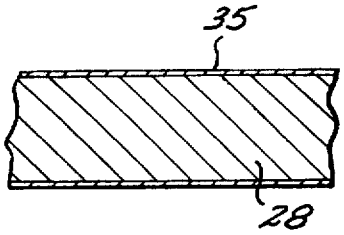
FIG. 8 is a schematic enlarged partial view of the filament shown in FIG. 7.

The filaments 28 which have been subjected to the above described process have a thin, dark chrome-like blue tungsten phosphide ($WP_x$) layer on their surface. This is indicated in the schematic, enlarged view of FIG. 8. The change in visual appearance of the filaments 28 in accordance with the present invention is quite significant when the dark chrome-like color of the filaments 28 is contrasted with the bright mirror like appearance of the tungsten metal of the filaments before exposure to hot phosphorous vapors.

Figure 11:
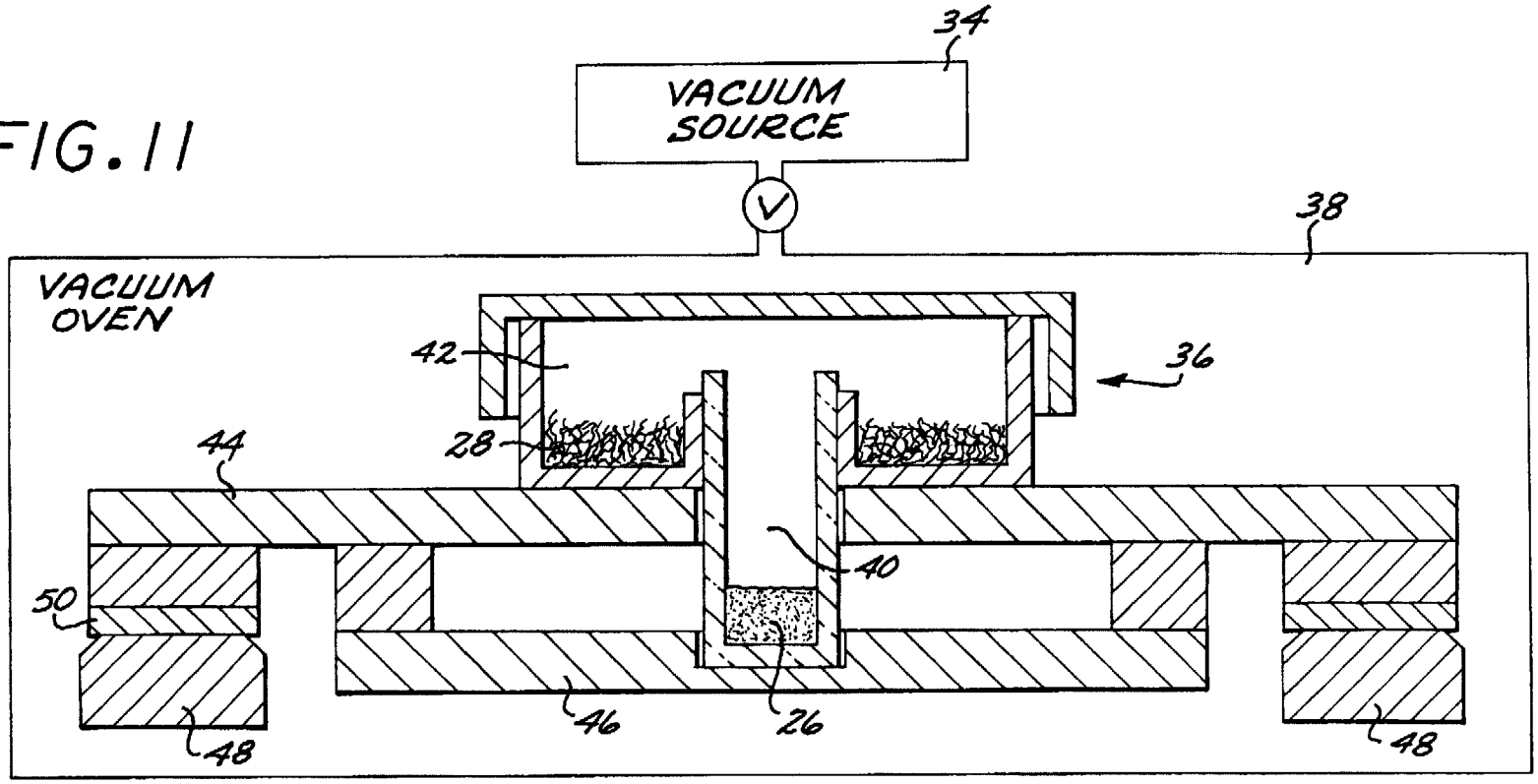
FIG. 11 is a schematic view, in cross section, of a second preferred embodiment of the apparatus wherein the process of the present invention is performed.

FIG. 11 discloses another preferred embodiment 36 of the vessel in which the process of the invention is performed, and a vacuum furnace 38 with specially adapted heating elements to heat the vessel 36 and furnace. Thus, the vessel 36 includes a tube-like first compartment 40 into which red phosphorous reagent 26 is placed. Annular space in a dish forms the second compartment 42 into which the filaments 28 are placed. A first graphite plate 44 is disposed below the first compartment, and a second graphite plate 46 is disposed below the second compartment. The furnace 38 is heated by passing current through the graphite plates 44 and 46. The current is supplied through the copper electrodes 48 and stainless steel spacers 50 which are provided to support the heating apparatus. Dimensions of the graphite plates 44 and 46 can be selected such that the temperature in the first compartment 40 heating the phosphorous reagent rises only to approximately 400° C. This temperature is sufficient to vaporize phosphorous. The temperature in the second compartment 42, on the other hand, is raised and maintained in the 700° to 725° range, which is considered optimal for forming the tungsten phosphide ($WP_x$) layer.

Figure 12:
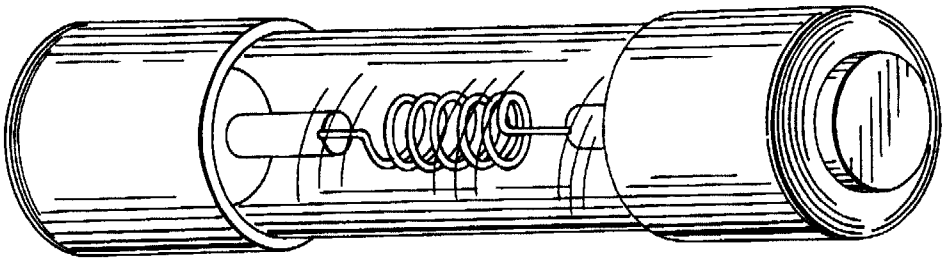
FIG. 12 is perspective view of a miniature light bulb which is made in accordance with the process of the present invention.

The filaments 28 which have been provided with the tungsten phosphide ($WP_x$) layer in accordance with the present invention are incorporated into incandescent lamps in further manufacturing steps which may be performed in accordance with state-of-the-art. For example, the filaments 28 are incorporated into the miniature lamps described in U.S. Pat. No. 5,138,226 or 5,382,874. A miniature lamp which incorporates the filament in accordance with the present invention, and which except for its filament, is of the type otherwise described in U.S. Pat. No. 5,138,226, is shown in FIG. 12. The tungsten phosphide ($WP_x$) layer on the surface of the filaments processed in accordance with the present invention provides protection against oxidation during handling and further processing while the filaments are incorporated into incandescent lamps.

Experience has shown that miniature lamps which incorporate filaments in accordance with the present invention have substantially improved production yield, substantially longer useful life, and more uniform and better operating characteristics (brightness, current draw and operating temperature) than lamps of similar construction but without employing a gettering agent.

Several modifications of the present invention may become readily apparent to those skilled in the art in light of the foregoing disclosure. Therefore, the scope of the present invention should be interpreted solely from the following claims, as such claims are read in light of the disclosure.

What is claimed is:

1. In the process for manufacturing incandescent light bulbs of the type which include a gettering agent within the light bulb, the improvement comprising the steps of:

placing a plurality of tungsten filaments for the light bulbs into a vacuum furnace;

placing red phosphorous on the proximity of said plurality of filaments in the vacuum furnace;

heating the vacuum furnace until the temperature of said plurality of filaments rises above approximately 675° C., and until the temperature of the red phosphorous reaches at least approximately 400° C., maintaining said filaments in temperature range above approximately 675° C. for a time period and maintaining the temperature of the red phosphorous at least approximately 400° C. for a time period;

continuously evacuating the vacuum furnace at least during part of the time period while the furnace is being heated whereby said plurality of filaments are exposed to vapors of phosphorous and react therewith to form tungsten phosphides on the surface of said filaments, and discontinue heating and evacuating the vacuum furnace and removing said plurality of filaments from the furnace.

2. In the process for manufacturing incandescent light bulbs of the type which include a gettering agent within the light bulb, the improvement comprising the steps of:

placing a plurality of tungsten filaments for the light bulbs into a vacuum furnace;

placing red phosphorous in the proximity of said plurality of filaments in the vacuum furnace;

heating the vacuum furnace until the temperature of said plurality of filaments rises to a range approximately between 675° and 725° C., and until the temperature of the red phosphorous reaches a range approximately between 675° and 725° C., maintaining said filaments in said temperature range above approximately 675° C. for a first time period and maintaining the temperature of the red phosphorous in said range for a second time period;

evacuating the vacuum furnace at least during part of the first time period whereby said plurality of filaments are exposed to vapors of phosphorous and react therewith to form tungsten phosphides on the surface of said filaments, and discontinue heating and evacuating the vacuum furnace and removing said plurality of filaments from the furnace.

3. The improvement in the process in accordance with claim 2 where said plurality of filaments and said red phosphorous are both heated to a temperature of approximately 725° C.

4. The improvement in the process in accordance with claim 3 where the step of evacuating the vacuum furnace is commenced when the temperature of said plurality of filaments and of said red phosphorous reaches approximately 200° C.

5. In the process for manufacturing incandescent light bulbs of the type which include a gettering agent within the light bulb, the improvement comprising the steps of:

placing a plurality of filaments for the light bulbs into a vacuum furnace;

placing red phosphorous in the proximity of said plurality of filaments in the vacuum furnace;

heating the vacuum furnace until the interior temperature rises above approximately 675° C. and maintaining the interior temperature above approximately 675° C. for a predetermined time period;

after the step of heating is commenced evacuating the vacuum furnace by connecting the furnace to a source of vacuum and keeping the furnace connected to the source of vacuum thereby keeping the furnace evacuated for at least a part of the predetermined time period and thereby exposing said plurality of filaments to vapors of phosphorous and causing the vapors to react with the filaments to form tungsten phosphides on the surface of said filaments, and discontinue heating and evacuating the vacuum furnace and removing said plurality of filaments from the furnace.

6. The improvement in the process in accordance with claim 5 where the step of evacuating is commenced when the interior temperature reaches approximately 200° C.

7. The improvement in the process in accordance with claim 5 where said plurality of filaments and said red phosphorous each are placed into a vessel, the vessel remains unsealed and is placed into the vacuum furnace.

8. In the process for manufacturing incandescent light bulbs of the type which include a gettering agent within the light bulb, the improvement comprising the steps of:

placing a plurality of filaments for the light bulbs into a vacuum furnace;

placing red phosphorous in the proximity of said plurality of filaments in the vacuum furnace;

heating the vacuum furnace until the interior temperature rises to approximately 725° C. and maintaining the interior temperature at approximately 725° C. for a predetermined time period;

after the step of heating is commenced evacuating the vacuum furnace by connecting the furnace to a source of vacuum, and keeping the furnace evacuated for at least a part of the predetermined time period and thereby exposing said plurality of filaments to vapors of phosphorous and causing the vapors to react with the filaments to form tungsten phosphides on the surface of said filaments, and discontinue heating and evacuating the vacuum furnace and removing said plurality of filaments from the furnace.

9. The improvement in the process in accordance with claim 8 where the interior temperature of the vacuum furnace is raised substantially linearly from ambient temperature to approximately 725° C.

10. In the process for manufacturing incandescent light bulbs of the type which include a gettering agent within the light bulb, the improvement comprising the steps of:

placing a plurality of filaments for the light bulbs into a vacuum furnace;

placing red phosphorous in the proximity of said plurality of filaments in the vacuum furnace;

heating the vacuum furnace until the interior temperature rises above approximately 675° C. and maintaining the interior temperature above approximately 675° C. for a predetermined time period, said step of heating being conducted for approximately 10 minutes;

after the step of heating is commenced evacuating the vacuum furnace by connecting the furnace to a source of vacuum, and keeping the furnace evacuated for at least a part of the predetermined time period and thereby exposing said plurality of filaments to vapors of phosphorous and causing the vapors to react with the filaments to form tungsten phosphides on the surface of said filaments, and discontinue heating and evacuating the vacuum furnace and removing said plurality of filaments from the furnace.

11. A process for manufacturing filaments suitable for incorporation into incandescent light bulbs, said filaments comprising a tungsten core and an outer surface of tungsten phosphide, the process comprising:

placing a plurality of tungsten filaments into a vacuum furnace;

heating the furnace to maintain the tungsten filaments at a temperature above approximately 675° C.;

evacuating the furnace and keeping the furnace evacuated by having it connected to a vacuum source while the temperature is maintained above approximately 675° C.;

exposing said filaments to vapors of phosphorous while maintaining said plurality of filaments at a temperature above approximately 675° C. and while keeping the furnace evacuated, and allowing the furnace to cool and removing said plurality of filaments from the furnace.

12. The process in accordance with claim 11 where the furnace is evacuated to a pressure of approximately 100 millitorr.

13. The process in accordance with claim 11 where the step of exposing said filaments to vapors of phosphorous comprises keeping solid red phosphorous within the furnace and maintaining said solid phosphorous at a temperature of at least approximately 400° C.

14. A process for manufacturing filaments suitable for incorporation into incandescent light bulbs, said filaments comprising a tungsten core and an outer surface of tungsten phosphide, the process comprising:

placing a plurality of tungsten filaments into a vacuum furnace;

heating the furnace to maintain the tungsten filaments at a temperature at approximately 725° C.;

evacuating the furnace and keeping the furnace evacuated while the temperature is maintained at approximately 725° C.;

exposing said filaments to vapors of phosphorous while maintaining said plurality of filaments at a temperature of approximately 725° C. and while keeping the furnace evacuated, and allowing the furnace to cool and removing said plurality of filaments from the furnace.

15. A process for manufacturing filaments suitable for incorporation into incandescent light bulbs, said filaments comprising a tungsten core and an outer surface of tungsten phosphide, the process comprising:

placing a plurality of tungsten filaments into a vacuum furnace;

heating the furnace to maintain the tungsten filaments at a temperature in the range of approximately 675° to 725° C.;

evacuating the furnace and keeping the furnace evacuated, the step of evacuating the furnace comprising connecting the furnace to a vacuum source when the internal temperature of the furnace is approximately 200° C., and thereafter keeping the furnace connected to the vacuum source while the temperature is raised to and thereafter maintained in the range of approximately 675° to 725° C.;

exposing said filaments to vapors of phosphorous while maintaining said plurality of filaments at a temperature in the range of approximately 675° to 725° C. and while keeping the furnace evacuated, and allowing the furnace to cool and removing said plurality of filaments from the furnace.

16. A process for manufacturing filaments suitable for incorporation into incandescent light bulbs, said filaments comprising a tungsten core and an outer surface of tungsten phosphide, the process comprising:

placing a plurality of tungsten filaments into a vacuum furnace;

heating the furnace to maintain the tungsten filaments at a temperature above approximately 675° C.;

evacuating the furnace and keeping the furnace evacuated while the temperature is maintained above approximately 675° C.;

exposing said filaments to vapors of phosphorous, the step of exposing said filaments to vapors of phosphorous comprises keeping solid red phosphorous within the furnace and maintaining said solid phosphorous at a temperature in the range of approximately 675° to 725° C. and while keeping the furnace evacuated, and allowing the furnace to cool and removing said plurality of filaments from the furnace.

* * * * *